US008800422B2

(12) United States Patent
Norton et al.

(10) Patent No.: US 8,800,422 B2
(45) Date of Patent: Aug. 12, 2014

(54) BOLT ASSEMBLY FOR FIREARMS

(71) Applicant: RA Brands, L.L.C., Madison, NC (US)

(72) Inventors: Vincent Norton, Elizabethtown, KY (US); Travis T. Baker, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/826,711

(22) Filed: Mar. 14, 2013

(65) Prior Publication Data

US 2014/0059910 A1 Mar. 6, 2014

Related U.S. Application Data

(60) Provisional application No. 61/742,881, filed on Aug. 20, 2012.

(51) Int. Cl.

| | |
|---|---|
| ***F41A 3/26*** | (2006.01) |
| ***F41A 3/00*** | (2006.01) |
| ***F41A 3/30*** | (2006.01) |

(52) U.S. Cl.

CPC ... *F41A 3/00* (2013.01); *F41A 3/26* (2013.01); *F41A 3/30* (2013.01)

USPC ..... 89/185; 42/16; 42/17; 42/19

(58) Field of Classification Search

CPC ..... F41A 3/26

USPC ..... 89/185; 42/16–17, 19

See application file for complete search history.

(56) References Cited

U.S. PATENT DOCUMENTS

| | | | |
|---|---|---|---|
| 1,318,423 | A | 10/1919 | Williams |
| 1,349,675 | A | 8/1920 | Johnson |
| 2,418,946 | A | 4/1947 | Loomis |
| 2,491,218 | A | 12/1949 | Sefried |
| 2,601,808 | A | 7/1952 | Clarke |
| 2,685,754 | A | 8/1954 | Crittendon et al. |

(Continued)

FOREIGN PATENT DOCUMENTS

| | | |
|---|---|---|
| DE | 28445 C | 9/1884 |
| DE | 708197 | 7/1941 |

(Continued)

OTHER PUBLICATIONS

International Search Report dated Nov. 8, 2013 for International Patent Application No. PCT/US2013/054941 filed Aug. 14, 2013.

(Continued)

*Primary Examiner* — Michael David

(74) *Attorney, Agent, or Firm* — Womble Carlyle Sandridge & Rice, LLP

(57) ABSTRACT

A bolt assembly for a firearm such as an auto-loading or pump action shotgun includes a bolt body, bolt carrier and a bolt head. The bolt head is received within the bolt body and is rotatable within the bolt body to lock the bolt assembly into battery prior to firing the weapon, but does not extend from the bolt body during such rotation. The bolt carrier translates axially relative to the bolt body so as to cause rotation of the bolt head. The extractor for the firearm can be pivotally attached to the bolt body, while the ejector further can be integrated into the bolt assembly for engaging and ejecting a shell or cartridge after firing.

42 Claims, 7 Drawing Sheets

(56) References Cited

U.S. PATENT DOCUMENTS

| | | | | |
|---|---|---|---|---|
| 2,861,374 | A | 11/1958 | Hampton | |
| 2,941,449 | A | 6/1960 | Reed | |
| 2,976,637 | A | 3/1961 | Robinson, Jr. | |
| 3,255,547 | A | 6/1966 | Gregory, Jr. | |
| 3,368,298 | A | 2/1968 | Browning | |
| 3,397,473 | A | 8/1968 | Browning | |
| 3,619,926 | A | 11/1971 | Alday | |
| 3,631,621 | A | 1/1972 | Tito | |
| 3,653,140 | A | 4/1972 | Alday | |
| 3,675,534 | A | 7/1972 | Beretta | |
| 3,680,433 | A | 8/1972 | Tollinger | |
| 3,688,640 | A | 9/1972 | Seecamp | |
| 3,759,135 | A | 9/1973 | Tollinger | |
| 3,782,022 | A | 1/1974 | Bielfeldt et al. | |
| 3,789,730 | A | 2/1974 | Helmes | |
| 3,848,510 | A | 11/1974 | Wolpert | |
| 3,919,800 | A | 11/1975 | Browning | |
| 3,938,271 | A | 2/1976 | Hyytinen | |
| 3,996,684 | A | 12/1976 | Bauman et al. | |
| 3,996,685 | A | 12/1976 | Bauman et al. | |
| 4,135,434 | A | 1/1979 | Hurklemann et al. | |
| 4,172,410 | A | 10/1979 | Anderson et al. | |
| 4,305,218 | A | 12/1981 | Godsey | |
| 4,344,246 | A | 8/1982 | Bauman et al. | |
| 4,389,919 | A | 6/1983 | Kast et al. | |
| 4,445,292 | A | 5/1984 | Martin | |
| 4,454,672 | A | 6/1984 | Timari | |
| 4,516,466 | A | 5/1985 | Jennie | |
| 4,593,488 | A | 6/1986 | Ruger | |
| 4,604,942 | A | 8/1986 | Benelli | |
| 4,856,217 | A | 8/1989 | Benelli | |
| 4,867,039 | A | 9/1989 | Dobbins | |
| 4,893,547 | A * | 1/1990 | Atchisson | 89/187.01 |
| 4,942,802 | A | 7/1990 | Stoner | |
| 5,373,775 | A | 12/1994 | Findlay, Sr. et al. | |
| 5,463,828 | A | 11/1995 | Andrejevic | |
| 5,551,180 | A | 9/1996 | Findlay et al. | |
| 5,682,007 | A | 10/1997 | Dobbins | |
| 5,718,073 | A | 2/1998 | Sachse et al. | |
| 5,740,516 | A | 4/1998 | Jiranek, II et al. | |
| 5,768,815 | A | 6/1998 | Casull | |
| 5,771,620 | A | 6/1998 | Crawford et al. | |
| 5,806,226 | A | 9/1998 | Norton et al. | |
| 5,918,401 | A | 7/1999 | Rowlands | |
| 5,987,798 | A | 11/1999 | Ronkainen | |
| 6,189,253 | B1 | 2/2001 | Knight et al. | |
| 6,345,460 | B2 | 2/2002 | Hashman | |
| 6,347,569 | B1 | 2/2002 | Butler | |
| 6,393,961 | B1 | 5/2002 | Ockenfuss | |
| 6,418,655 | B1 | 7/2002 | Kay | |
| 6,484,430 | B1 | 11/2002 | Robinson et al. | |
| 6,536,150 | B2 | 3/2003 | Schweikart | |
| 6,564,691 | B2 | 5/2003 | Butler | |
| 6,625,917 | B2 | 9/2003 | Murello et al. | |
| 6,708,437 | B2 | 3/2004 | Murello | |
| 6,732,465 | B2 | 5/2004 | Strayer | |
| 6,910,404 | B2 | 6/2005 | Wolff et al. | |
| 7,000,345 | B1 | 2/2006 | Kay | |
| 7,107,715 | B2 | 9/2006 | Keeney et al. | |
| 7,219,461 | B1 | 5/2007 | Keeney et al. | |
| 7,237,469 | B2 * | 7/2007 | Murello | 89/191.01 |
| 7,331,135 | B2 | 2/2008 | Shimi | |
| 7,533,598 | B1 | 5/2009 | Murphy | |
| 7,707,923 | B2 | 5/2010 | Gussalli Beretta | |
| 7,971,379 | B2 | 7/2011 | Robinson et al. | |
| 7,975,595 | B2 | 7/2011 | Robinson et al. | |
| 8,079,168 | B2 | 12/2011 | Lesenfants | |
| 2003/0089018 | A1 * | 5/2003 | Reynolds | 42/105 |
| 2005/0066564 | A1 | 3/2005 | Keeney et al. | |
| 2010/0175547 | A1 * | 7/2010 | Hoffman | 89/9 |
| 2013/0133236 | A1 * | 5/2013 | Merritt et al. | 42/70.01 |
| 2014/0000145 | A1 * | 1/2014 | Merritt et al. | 42/114 |

FOREIGN PATENT DOCUMENTS

| | | | |
|---|---|---|---|
| EP | 0 860 677 | A2 | 8/1998 |
| EP | 0 860 677 | A3 | 9/1999 |
| EP | 1 345 000 | A1 | 9/2003 |
| FR | 2 372 408 | | 6/1978 |
| WO | WO 2014-031410 | A1 | 2/2014 |

OTHER PUBLICATIONS

Written Opinion dated Nov. 8, 2013 for International Patent Application No. PCT/US2013/054941 filed Aug. 14, 2013.

Supplementary European Search Report dated Nov. 27, 2006 for European Patent Application No. 04 80 9407.

International Search Report for PCT/US2012/068417 dated Mar. 18, 2013.

Written Opinion for PCT/US2012/068417 dated Mar. 18, 2013.

* cited by examiner

BOLT ASSEMBLY FOR FIREARMS

CROSS-REFERENCE TO RELATED APPLICATION

This application claims the benefit of U.S. Provisional Patent Application Ser. No. 61/742,881 filed on Aug. 20, 2012. The specification and drawings of the provisional patent application are specifically incorporated by reference herein.

TECHNICAL FIELD

Embodiments of the invention generally relate to a bolt assembly for firearms, and in particular to a rotating bolt assembly for shotguns wherein the bolt head rotates to lock the bolt into battery prior to firing but does not extend from the bolt body during operation.

BACKGROUND

In semiautomatic shotguns and in some pump shotguns, a rotating bolt head typically is used, with the bolt head generally translating or extending outwardly from the bolt carrier during operation, and at the same time rotating for engagement, extraction and ejection of a spent shell and to enable loading of a next shell and locking of the bolt into battery in the barrel of the shotgun. Since the bolt head often translates or extends a substantial distance in most rotary bolt assemblies, a barrel extension typically is provided between the barrel of the firearm and the receiver. Such barrel extensions generally are required to have a significant length to accommodate the full extension of the bolt head. One of the issues with barrel manufacturing for shotguns therefore has been the provision of longer barrel extensions to accommodate the translating rotary bolt head, which can, however, create issues with regard to machining of the barrel around the lockup and chamber area thereof. In addition, most traditional rotary bolt designs further typically require a longer receiver, in addition to the use of a longer barrel extension, all of which adds weight and further cost and complexity to the manufacture of these shotguns.

Accordingly, it can be seen that a need exists for a bolt assembly for a shotgun that addresses the foregoing and other related and unrelated problems in the art.

SUMMARY

The embodiments disclosed are directed to a bolt assembly for a shotgun, such as an auto-loading or pump shotgun. The bolt assembly includes a bolt body, bolt head and a bolt carrier, with the bolt head being rotatable with respect to the bolt body so as to lock the bolt head into battery within the barrel of the shotgun to contain firing pressures. The bolt carrier is located below the bolt body and translates relative to the bolt body and bolt head. The bolt carrier further includes a cam pin that extends into a cam surface cut in the bolt head such that the longitudinal or translating movement of the bolt carrier, and thus the cam pin therewith, causes the bolt head to rotate. When the bolt carrier moves toward the forward position, the bolt head can be rotated in a generally clockwise direction so that the lugs on the bolt head engage lug cuts in the barrel of the firearm to lock the bolt head into a battery, and as the bolt carrier is translated rearwardly upon firing, the bolt head can be rotated in a generally clockwise direction to disengage the lugs of the bolt head from the barrel for extraction and ejection of the spent shell and loading of a new shell in the chamber of the firearm. The bolt assembly includes a bolt carrier blocker along one of the sides adjacent and interacting with interior of the receiver. The bolt carrier blocker locks the bolt head in the fully clockwise direction (open position) when the bolt carrier translates rearward, clearing the bolt head from the lockup. The bolt assembly further can include a bolt handle inserted into the bolt carrier along one of the sides thereof. The bolt handle enables the manual translation of the bolt assembly in a rearward direction for opening and/or clearing of the chamber and/or loading a new shell in the chamber as needed.

In the bolt assembly of the disclosed embodiments, the bolt head generally is held within the bolt body by an extractor that is hingedly affixed to the bolt body and a cam pin, which is captured in the assembly by the firing pin. The extractor includes a forward, engaging portion that extends forwardly of the lugs of the bolt head, a rear portion that is pivotally connected to the bolt body, and a slotted intermediate section that engages a corresponding recessed portion of the bolt head so as to enable rotation of the bolt head with respect to the extractor. The bolt assembly further includes an ejector mounted along an opposite side of the bolt body from the extractor and generally comprising an elongated rod that is translatable through the bolt body. As the bolt body is moved rearwardly upon firing, the ejector rod engages the back of the firearm receiver and is driven forwardly relative to the bolt body, moving through a shell support mounted along the bolt body for engaging and ejecting a shell from the firearm. The shell support generally is mounted along the bolt body and along the bolt head opposite the extractor and engages and supports the shell against the biasing force exerted thereagainst by the extractor so that the shell is held against the front face of the bolt head between extraction from the barrel and ejection from the firearm by the ejector.

In one embodiment, a rotatable bolt assembly is provided for a firearm having a receiver, a barrel and a fire control. The rotatable bolt assembly includes a bolt body; a bolt head received and retained within the bolt body; and a bolt carrier mounted below the bolt body and having a cam pin mounted thereto, the bolt carrier translatable relative to the bolt body to cause rotation of the bolt head as the bolt carrier is translated relative to the bolt body while the bolt head is retained within the bolt body and against extension therefrom.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

The following detailed description is provided as an enabling teaching of embodiments of the invention. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

Figure 1:
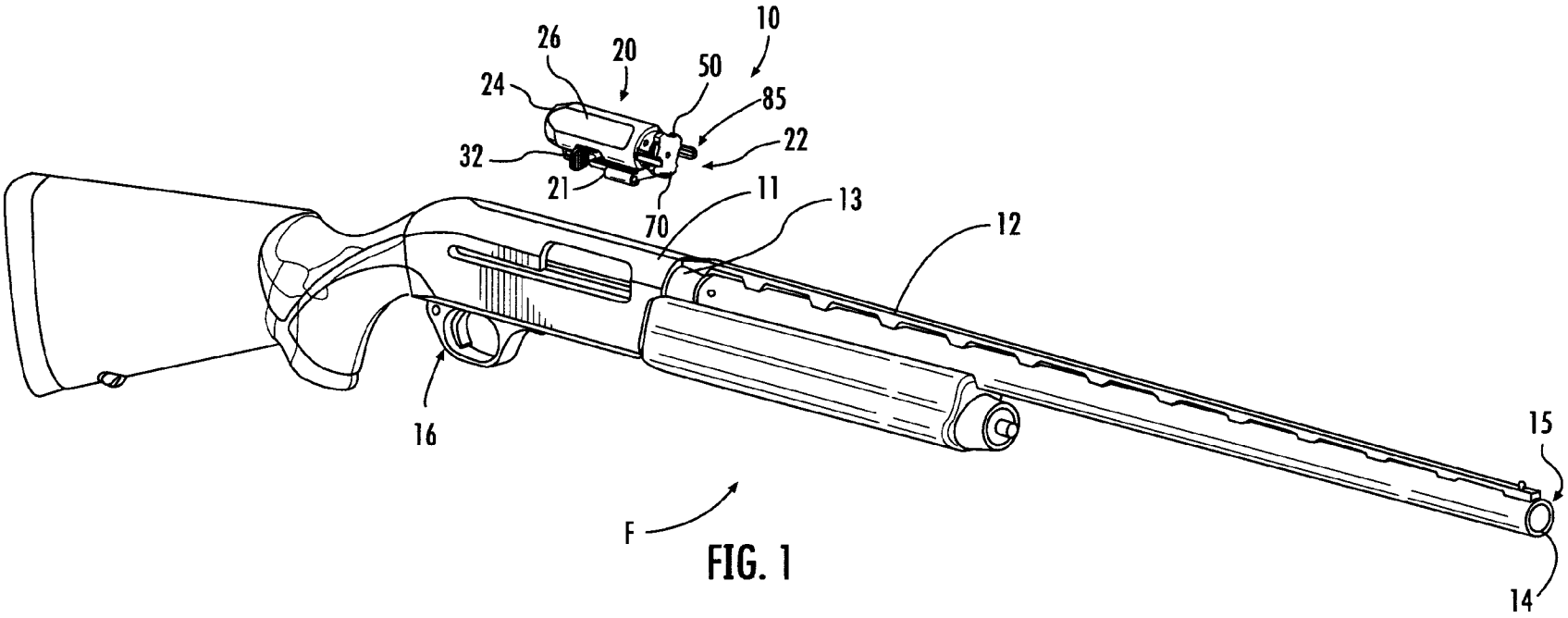
FIG. 1 illustrates a perspective illustration of the bolt assembly for a firearm according to one embodiment of the present invention.

Referring now to the drawings in which like numerals indicate like parts throughout the several views, FIGS. 1-7 generally illustrate the bolt assembly 10 for firearms according to the principles of the disclosed embodiments, which provides a more compact design enabling reduction in the length of the bolt assembly receiver and barrel extension of the firearm, while further enabling potential weight reduction and simplification of receiver and barrel machining. FIG. 1 generally illustrates the use of the bolt assembly 10 of the present invention in a firearm F, here indicated as a shotgun such as an auto-loading or pump action shotgun. However, it will be understood by those skilled in the art that the bolt assembly according to the principles of the disclosed embodiments also can be utilized in other types of firearms, including other types of long guns. As illustrated in FIG. 1, the firearm F generally will include a receiver 11, a barrel 12 having a chamber portion 13 defined at a distal or rear end thereof and a bore 14 extending therealong to a muzzle end 15, and a fire control 16 below the receiver. The bolt assembly 10 will be mounted within and is movable through the receiver portion 11 of the firearm F upon firing for extracting and ejecting a spent shell or round of ammunition from the chamber 13, and thereafter loading of a new shell or round of ammunition within the chamber.

Figure 2A:
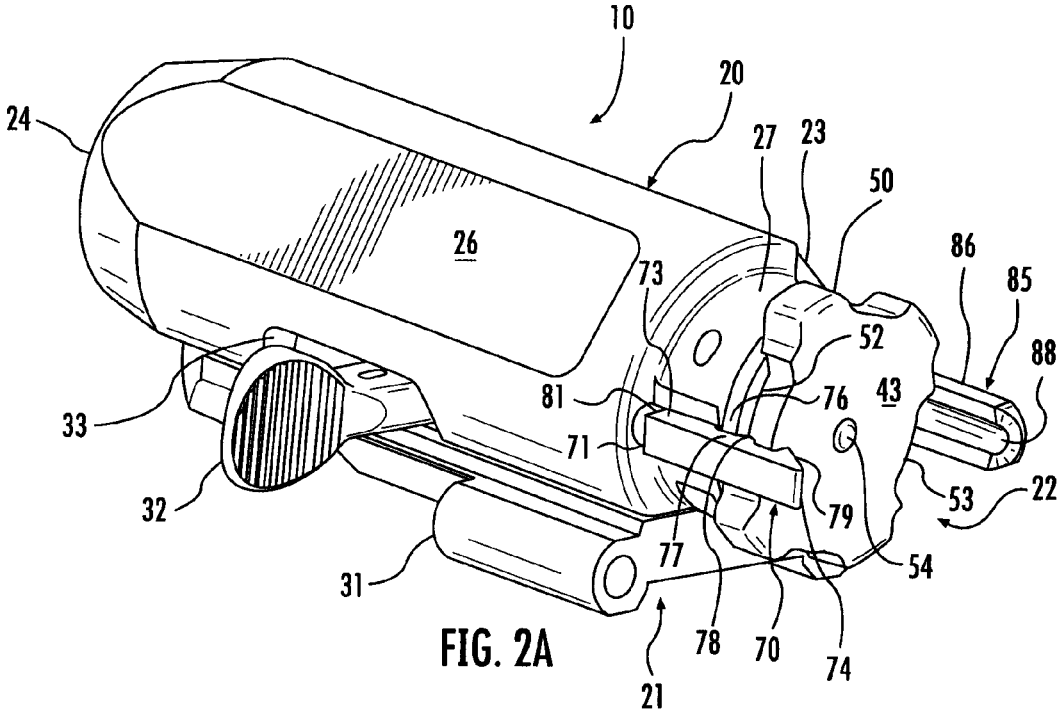
FIGS. 2A-2B illustrate perspective views of the bolt assembly of FIG. 1, viewed from forward and rearward ends respectively.

The bolt assembly 10 according to one embodiment is illustrated in further detail in FIGS. 2A-7. The bolt assembly 10 generally includes a bolt body 20 that is slidably mountable on a carrier 21 and receives a rotatable bolt head 22 therein. The bolt body, carrier and bolt head generally are formed from a high-strength metal or metal alloy material, such as steel, or could be formed from lighter weight metal materials due to the compact size and configuration of the bolt assembly 10, including, for example, aluminum or other high-strength metal or metal alloy materials. As illustrated in FIGS. 2A-2B, the bolt body further generally will have a substantially cylindrical configuration including a first, proximal or forward end 23, a second, rearward or distal end 24, a substantially cylindrical outer wall 26, and a collar or sleeve portion 27 at the forward end 23 of the bolt body, with an approximately centrally located bore or passage 28 (FIGS. 3-5) defined therein and in which the bolt head 22 is received.

Figure 2B:
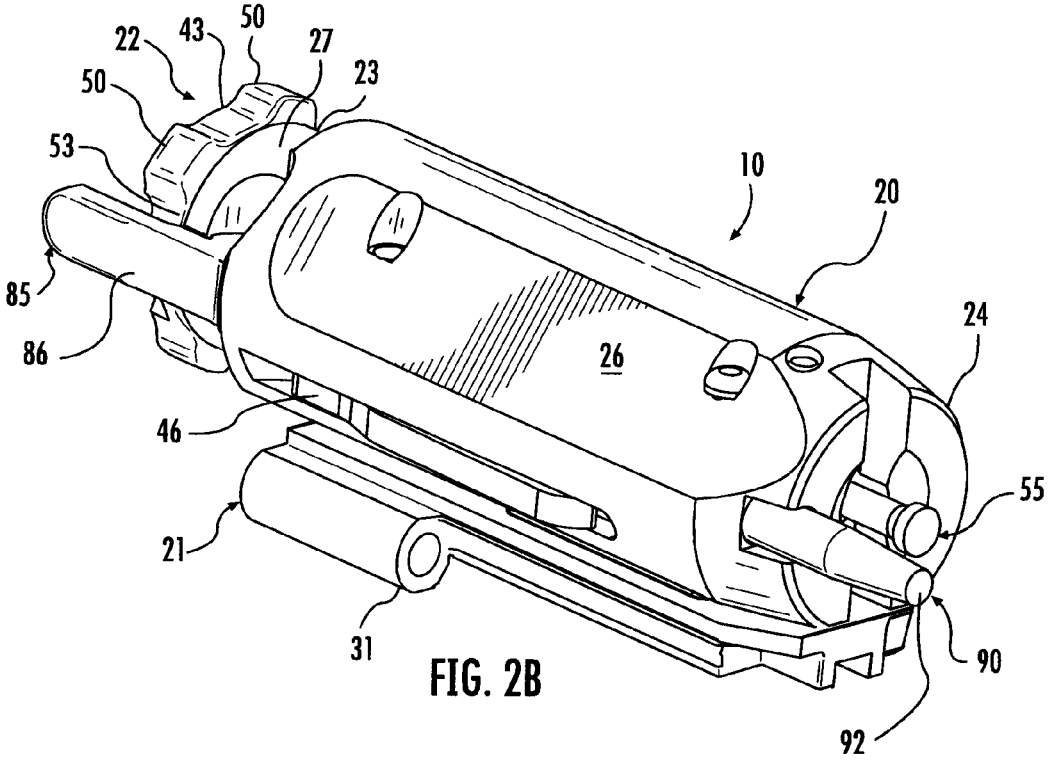
Figure 3:
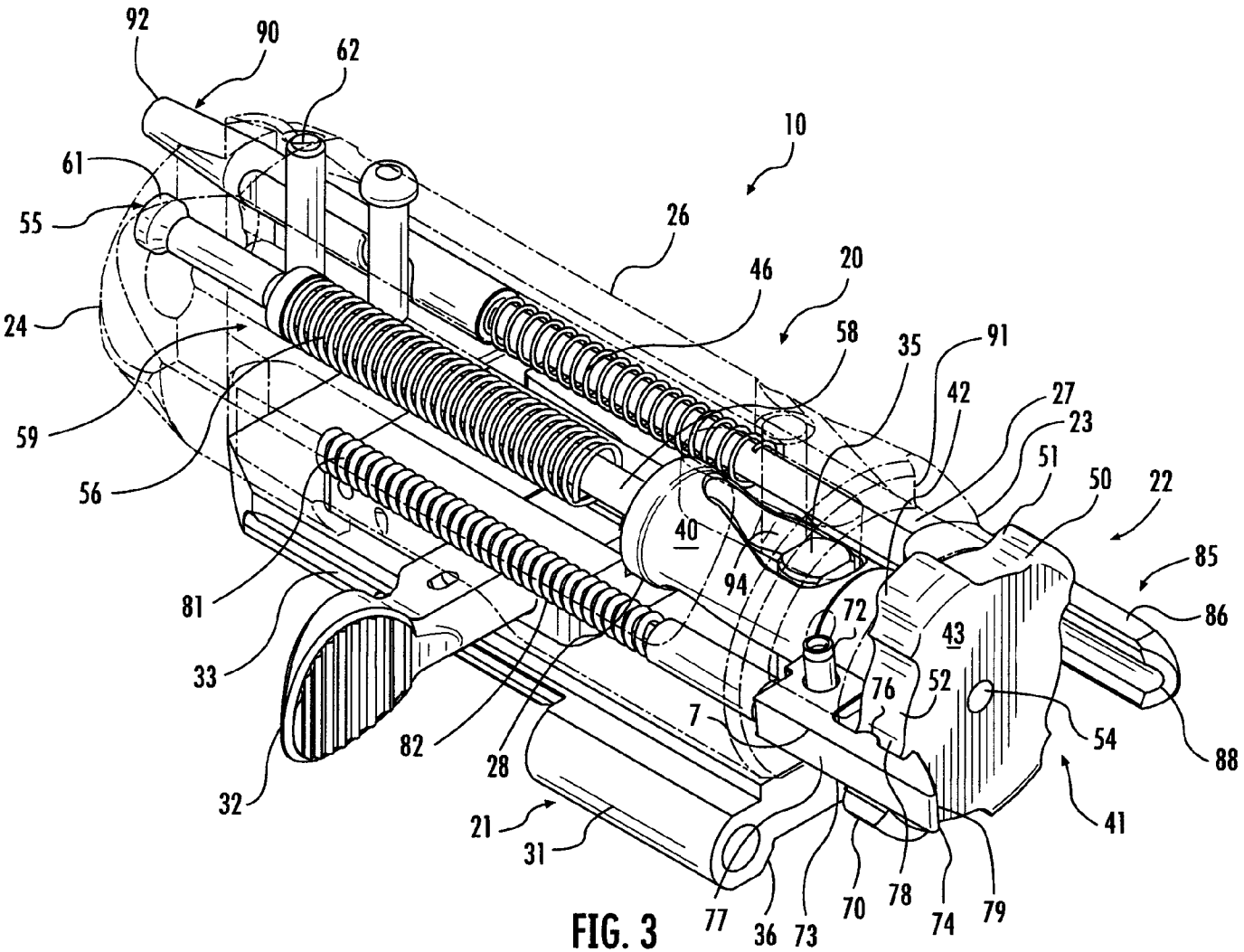
FIG. 3 illustrates a perspective illustration of the bolt assembly of FIGS. 1-2B illustrating the internal components of the bolt assembly of the present invention.
Figure 4:
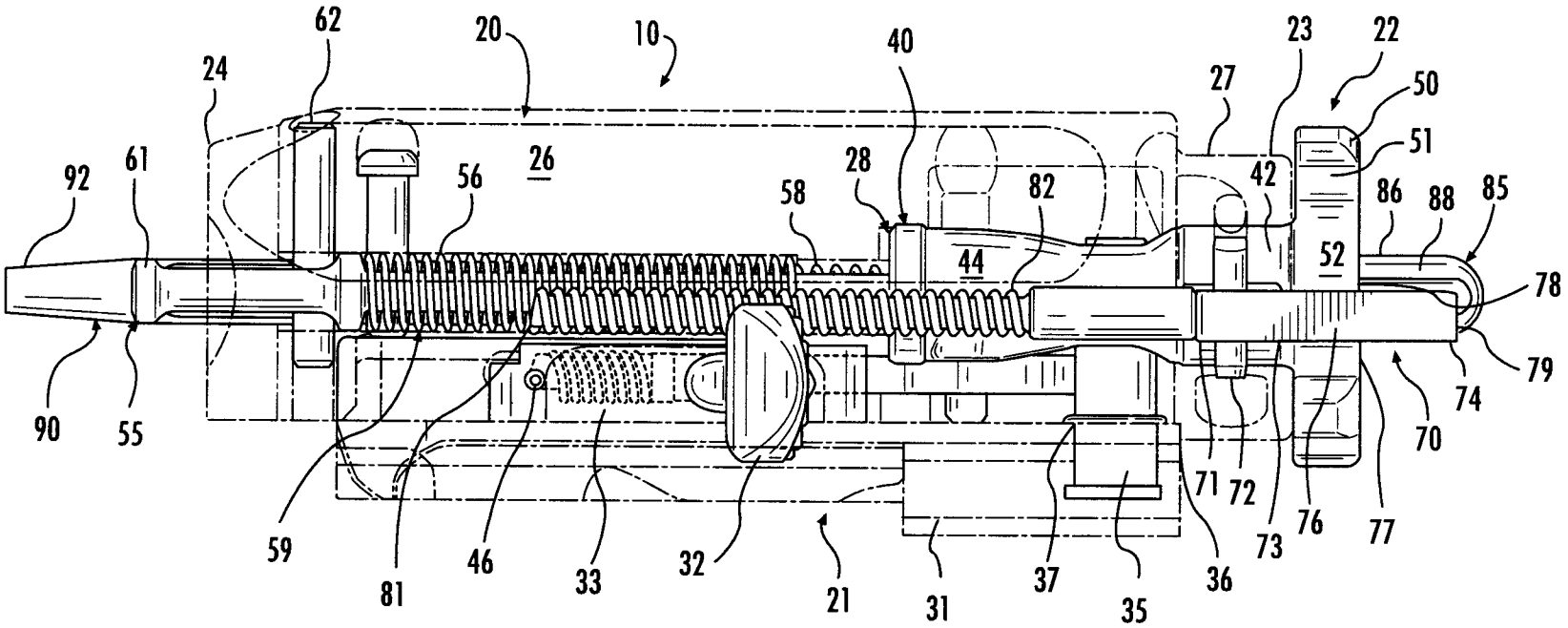
FIG. 4 illustrates a side elevational view of the bolt assembly of FIGS. 1-2B, illustrating the internal components thereof.
Figure 5:
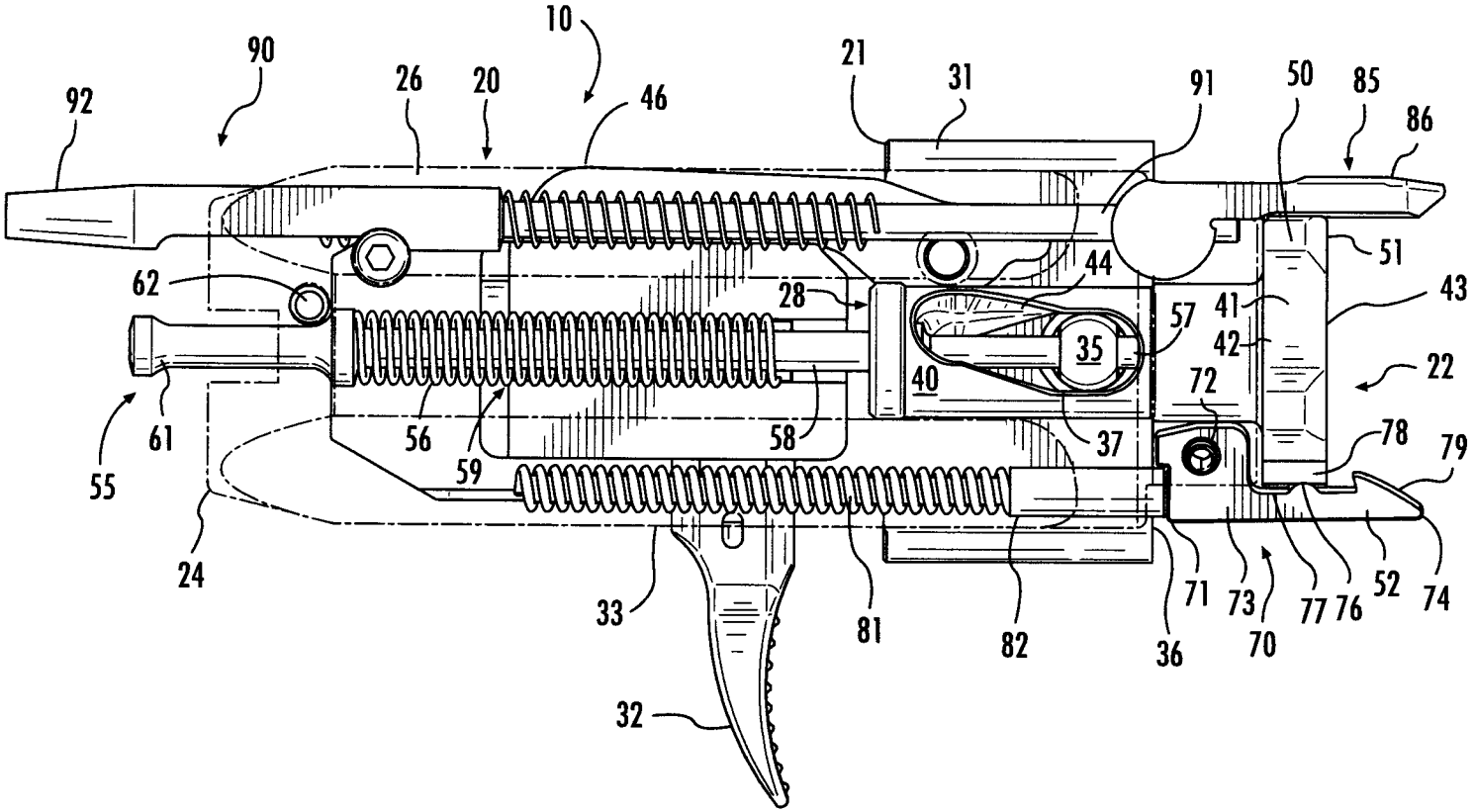
FIG. 5 illustrates a plan view of the bolt assembly of FIGS. 1-2B, illustrating the internal components thereof.

The bolt carrier 21 is illustrated in FIGS. 2A-7 as being mounted below the bolt body 20 and is translatable with respect to the bolt body. The bolt carrier generally includes a pair of carrier rod sleeves or guides 31 mounted on opposite sides of the bolt body and adapted to receive the carrier rods of the firearm (not shown) therein for guiding the translating movement of the carrier and bolt body along the receiver. A bolt handle 32 further can be mounted to the bolt carrier, as indicated in FIGS. 2A and 3-5, for manual operation of the bolt assembly 10. The bolt handle 32 can project through a slotted opening 33 formed in the outer wall 26 of the bolt body 20 and is movable therealong to enable manual operation of the carrier body with respect to the bolt body, as needed. As also illustrated in FIGS. 3-5, a cam pin 35 can be mounted to the bolt carrier 21 adjacent a forward end 36 thereof, and projects upwardly from the bolt carrier through a slot or similar opening 37 formed in the bolt body, into the bore 28 formed in the collar of the bolt body. The cam pin then engages the bolt head to cause rotation of the bolt head 22 as the bolt carrier is translated with respect to the bolt body.

As shown in FIGS. 3-5 and 7, the bolt head 22 generally has a substantially T-shaped construction with a longitudinally extending body 40 that is received within the bore 28 of the collar 27 of the bolt body 20, and a transversely oriented head or forward portion 41 at the first or distal end 42 of the bolt head engaging the collar 27 of the bolt body and having an essentially flat bolt face 43. A cam surface 44 (FIGS. 3-5) is generally formed at least partially about and along the body 40 of the bolt head and extending from adjacent a rear or proximal end 46 along the body of the bolt head toward the forward or head portion thereof. The cam surface 44 is engaged by the upstanding cam pin 35 of the bolt carrier 21 as indicated in FIGS. 3 and 5. As a result, as the pin is moved rearwardly or forwardly along its slot 37 formed in the bolt body, the engagement of the cam pin with the cam surfaces 44 of the bolt head body causes rotation of the bolt head.

For example, as the bolt carrier is translated rearwardly upon firing, the bolt head generally can be rotated in a clockwise direction as the cam pin of the bolt carrier is moved along the corresponding cam surfaces of the bolt head body so as to disengage a series of lugs 50 formed about the periphery 51 of the bolt head from the barrel of the firearm for extraction and ejection of a spent shell and to facilitate loading of a new shell in the chamber of the firearm. Thereafter, as the bolt carrier is moved toward a forward position with the return action of the firearm after firing, the cam pin of the bolt carrier is moved forwardly along the cam surface of the bolt head body, causing the bolt head to rotate in a generally counterclockwise direction so that the lugs 50 of the bolt head will engage corresponding lug cuts in the barrel of the firearm so as to lock the bolt head into engagement with the barrel in a battery condition for firing.

Figure 7:
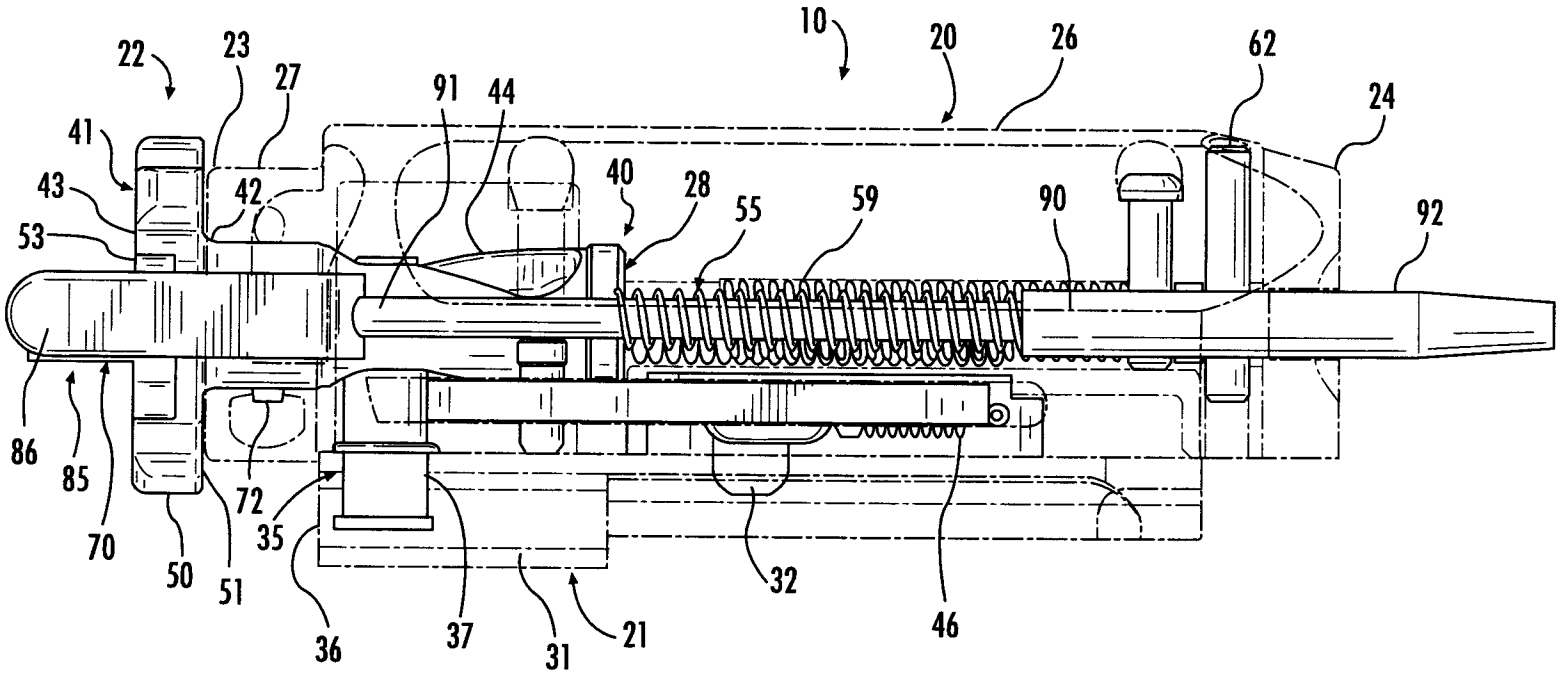
FIG. 7 illustrates a side elevational view showing the engagement of the bolt head by the shell support and bolt carrier blocker.

In addition, as illustrated in FIGS. 2B, 5 and 7, a bolt carrier blocker 46 generally is located along the side of the bolt assembly opposite the bolt handle. The bolt carrier blocker 46 projects from the bolt body 20 so as to engage and interact with the interior of the receiver of the firearm as the bolt assembly translates therealong. Thus, as the bolt carrier translates rearwardly after firing, the bolt carrier blocker engages and locks the bolt head against rotation, with the bolt head in a full clockwise or open position, clearing the bolt head from the lockup.

In an exemplary embodiment, while the bolt head is rotated as needed for locking the bolt head into a battery condition for firing of a round of ammunition, and/or thereafter is rotated in a reverse direction for extraction and ejection of a spent shell, the bolt head generally remains within a longitudinal position inside the bolt housing and does not translate or extend with respect to the bolt housing. Thus, the bolt assembly of the exemplary embodiment is enabled to be made much more compact with a smaller longitudinal length since its bolt head does not need to extend or otherwise translate into and out of its bolt body. This accordingly can enable a reduction in length of the receiver and/or reduction of a lengthy barrel extension, as well as substantially simplify machining/fabrication of the firearm barrel and receiver. The addition of shell support, shell ejection, and bolt head anti-rotation features, such as the bolt carrier blocker, in the bolt assembly also facilitate a reduction in length of the receiver and/or reduction in length of the barrel extension, substantially simplifying machine/fabrication of the firearm barrel and receiver.

Figure 6:
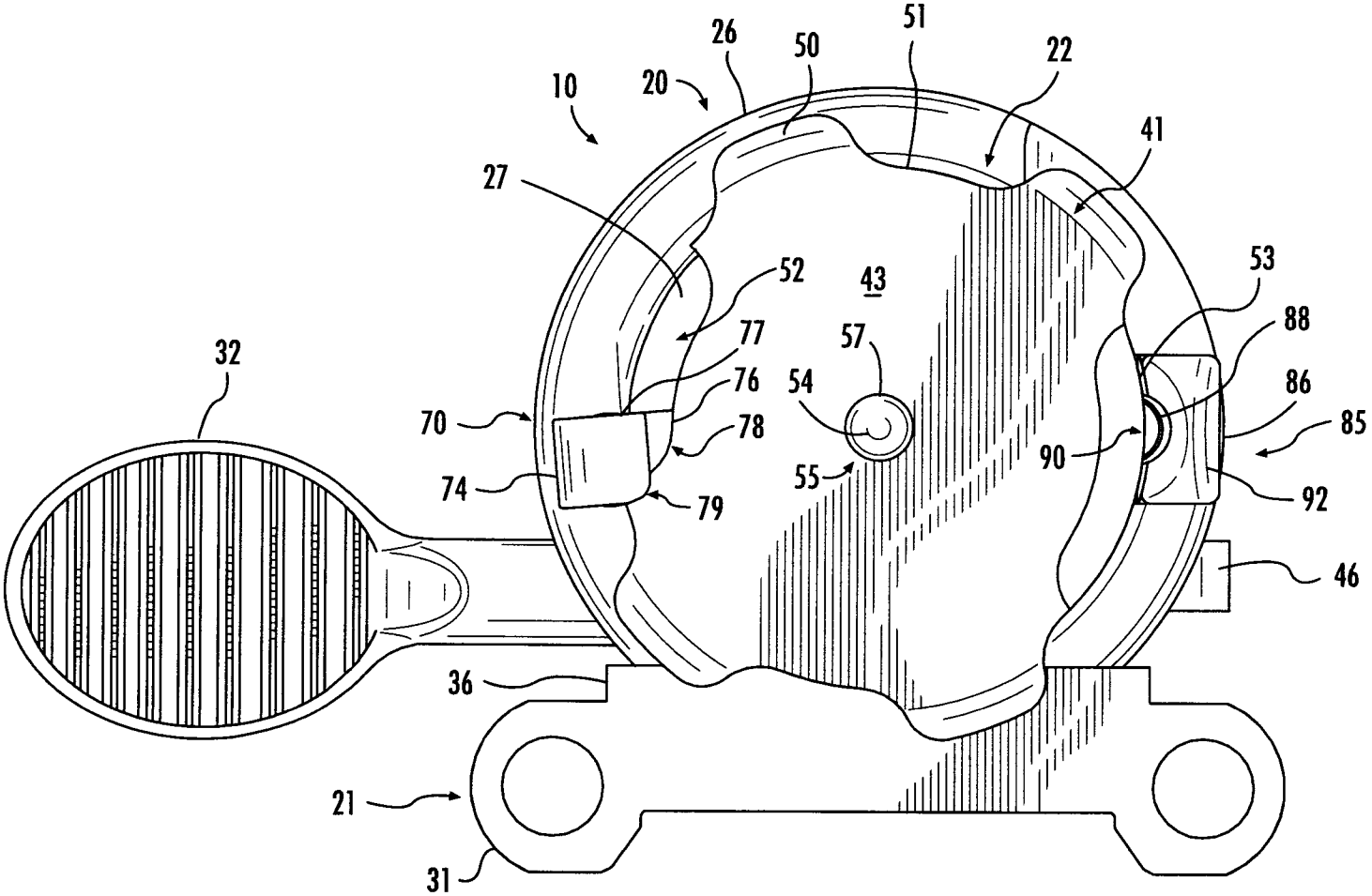
FIG. 6 illustrates an end view of the forward end of the bolt assembly of FIGS. 1-2B.

As illustrated in FIGS. 2A and 6, the head or forward portion 41 of the bolt head 22 is formed with a series of lugs 50 at spaced locations about its periphery 51. The lugs 51 generally can be slightly recessed and will be adapted to engage corresponding lug cuts in the barrel of the firearm to lock the bolt head in a battery condition for firing. Additionally, as FIGS. 2A and 6 show, a recessed area 52 will be formed between a pair of the lugs 50 on one side of the head portion 41 of the bolt head, while a cut-out or channel 53 is formed along the opposite side of the head portion. As further illustrated in FIGS. 3-5, a firing pin bore or passage 54 will be formed approximately centrally through the body and bolt face of the bolt head for passage of a portion of a firing pin 55 therethrough.

The firing pin 55 is received through the bolt body 20, as indicated in FIGS. 3-5, with the firing pin generally being in a recessed position as illustrated in FIGS. 3 and 5, by engagement thereof with a firing pin spring 56. The firing pin 55 generally includes a narrowed first, front or forward end 57 received and movable through the bore 54 of the bolt head, with an elongated body portion 58 extending rearwardly therefrom through a passage 59 formed in the bolt body 20, and about which the firing pin spring 56 is engaged. A second, rearward end or base 61 projects from the distal or second end 24 of the bolt body for engagement and actuation thereof by the hammer of the firearm during a firing operation.

As indicated in FIGS. 3-5, the firing pin is retained within the passage 59 of the bolt body 20 by a retaining pin 62 mounted within the bolt body 20 adjacent the rear or second end 24 thereof in a position so as to engage the body portion of the firing pin and prevent rearward movement of the firing pin out of the bolt body.

As shown in FIGS. 1-3 and 5-7, an extractor 70 is pinned to the collar portion 27 of the bolt body 20 adjacent the bolt head. The extractor is generally shown as a substantially L-shaped member having a base or rear portion 71 (FIG. 5) that projects into the collar of the bolt body and is pivotally attached thereto via a hinge pin 72. A longitudinally extending body portion 73 projects forwardly and along one side of the head portion 41 of the bolt head 22, terminating at a slanted, hooked front end 74. The hooked configuration of the front end 74 of the extractor body is adapted to engage a shell or cartridge for extraction thereof from the chamber of the firearm. As additionally illustrated in FIGS. 2A and 5-7, a slot or recess 76 is formed along an intermediate portion 77 of the extractor body. This slot 76 is adapted to receive a reduced edge section 78 of the head portion 41 of the bolt head 22 as defined by the extractor recess 52 of the bolt head. The bolt head is thus enabled to rotate with respect to the extractor, while the extractor remains in a generally longitudinally fixed position with respect to the rotating bolt head.

As further illustrated in FIGS. 3-5, an extractor spring 81 is received within the bolt body, extending along a recess or chamber 82 and engages the base of the extractor. As the slanted surface 79 of the front end 74 of the extractor 70 engages and rides over the rear end of a shell or round of ammunition, the extractor can be pivoted outwardly, and after the hooked front end of the extractor has passed over the rim of the shell, the extractor spring 81 generally will cause the extractor to pivot into a position engaging the shell or cartridge for extraction from the chamber of the firearm as the bolt assembly is translated rearwardly.

A shell support 85 also generally is mounted along the bolt body 20 on the opposite side of the bolt head 22 from the extractor, as indicated in FIGS. 2B, and 5-7. The design of the bolt assembly of the present invention that includes a shell support to be mounted to the body of the bolt assembly, rather than having to be mounted within the receiver of the firearm, which additionally simplifies machining and manufacture of the receiver or along a barrel extension. The shell support includes an elongated body 86, shown in FIG. 3 that includes a slot or recess 88 formed along the length thereof for receiving an ejector 90 therealong. During operation of the bolt assembly, the shell support engages and supports an opposite side of the shell or cartridge against the force being imparted thereto by the extractor as the extractor is urged into engagement with the shell, and works together with the extractor to hold the shell against the flat front face of the bolt head between extraction from the barrel and ejection from the firearm by the ejector 90.

As indicated in FIGS. 3, 5 and 7, the ejector 90 generally is an elongated rod having a proximal end 91 adjacent the bolt head and a distal end 92 that projects from the distal end of the bolt body and is adapted to engage the rear end of the receiver of the firearm as the bolt assembly is translated to its full rearward position. This in turn causes the ejector to be driven or urged through the bolt body and through the slot or recess 88 (FIG. 3) of the shell support 85 so as to engage and cause ejection of the shell or cartridge held between the shell support and the extractor as the bolt assembly reaches a rearward limit of its translating motion and enabling a next shell or cartridge to be loaded into the chamber of the firearm as the bolt assembly is translated forwardly back towards a locked, battery condition.

The compact design of the exemplary embodiment, which enables rotation of the bolt head without requiring the translation or extension of the bolt head from the bolt body, allows for a significant reduction in the overall length of the bolt assembly, which in turn enables shorter, more compact receivers to be utilized, as well as reducing the length of any barrel extension that might still be required, all of which in turn reduce the overall weight of the firearm. The non-translating/non-extending bolt head further allows for the extractor to be mounted to the bolt body, while also enabling the extractor to remain free from rotation with the bolt head, resulting in the simplification of the machining of the barrel and removal of features of the barrel required for receiving and mounting of the extractor therein, which features can catch or interfere with the feeding/loading of new shells or cartridges within the firearm chamber. Still further, the compact design also can enable simplified machining of the receiver and barrel by enabling the placement or location of the ejector within the bolt assembly as opposed to being in the receiver or along a long barrel extension and likewise controlling the rotation of the bolt head within the bolt body so as to not require additional features for preventing over-rotation of the bolt head when the gun is out of battery.

The corresponding structures, materials, acts, and equivalents of all means plus function elements in nay claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

The invention claimed is:

1. A rotatable bolt assembly for a firearm having a receiver, a barrel and a fire control, the bolt assembly comprising:

a bolt body;

a bolt head received and retained within the bolt body; and a bolt carrier mounted below the bolt body and having a cam pin mounted thereto, the bolt carrier translatable relative to the bolt body to cause rotation of the bolt head as the bolt carrier is translated relative to the bolt body while the bolt head is retained within the bolt body and against extension therefrom.

2. The rotatable bolt assembly of claim 1 further comprising a bolt carrier blocker located along the bolt body and adapted to engage the receiver and the bolt carrier as the bolt carrier is translated to lock the bolt head against rotation.

3. The rotatable bolt assembly of claim 1 wherein the bolt body comprises a substantially cylindrical configuration including a forward end, a rearward end, a substantially cylindrical outer wall, and a collar at the forward end.

4. The rotatable bolt assembly of claim 3 wherein the bolt body further comprises a centrally located bore defined therein for receiving the bolt head.

5. The rotatable bolt assembly of claim 4 wherein the cam pin mounted to the bolt carrier adjacent a forward end thereof projects upward through a slot formed in the bolt body into the bore formed in the collar of the bolt body.

6. The rotatable bolt assembly of claim 4 wherein the bolt head comprises a substantially T-shaped construction having a longitudinally extending body that is received within the bore of the collar of the bolt body and a transversely oriented forward portion at a first end of the bolt head engaging the collar of the bolt body and having a substantially flat face.

7. The rotatable bolt assembly of claim 6 further comprising a cam surface formed at least partially along the body of the bolt head, the cam surface engaged by the cam pin of the bolt carrier to cause rotation of the bolt head.

8. The rotatable bolt assembly of claim 7 wherein the bolt head further comprises a plurality of lugs at spaced locations around a periphery thereof, the plurality of lugs being disengaged from the barrel of the firearm by rearward movement of the cam pin along the cam surface as the bolt carrier translates rearwardly upon firing for extraction and ejection of a spent shell and loading of a new shell into a chamber of the firearm.

9. The rotatable bolt assembly of claim 8 wherein the cam pin moves forwardly along the cam surface as the bolt carrier translates to a forward position with a return action of the firearm causing the plurality of lugs to engage corresponding lug cuts in the barrel of the firearm to lock the bolt head into engagement with the barrel in a battery condition for firing.

10. The rotatable bolt assembly of claim 9 wherein the plurality of lugs are recessed and adapted to engage the corresponding lug cuts in the barrel.

11. The rotatable bolt assembly of claim 8 wherein the bolt head comprises a recessed area formed between a pair of lugs on one side of the bolt head and a channel formed along an opposite side of the bolt head.

12. The rotatable bolt assembly of claim 11 further comprising a firing pin bore formed approximately centrally through the bolt body and bolt face of the bolt head for passage of a portion of a firing pin therethrough.

13. The rotatable bolt assembly of claim 12 further comprising a retaining pin mounted within the bolt body adjacent a rear end thereof to engage a body portion of the firing pin and prevent rearward movement of the firing pin out of the bolt body.

14. The rotatable bolt assembly of claim 3 further comprising a bolt handle mounted to the bolt carrier through a slotted opening formed in the outer wall of the bolt body and movable therealong for manual translation of the carrier body relative to the bolt body.

15. The rotatable bolt assembly of claim 1 wherein the bolt carrier comprises a pair of carrier rod sleeves mounted on opposite sides of the bolt body and adapted to receive the carrier rods of the firearm for guiding the translating movement of the carrier and bolt body along the receiver.

16. The rotatable bolt assembly of claim 1 wherein the cam pin engages the bolt head to cause rotation of the bolt head as the bolt carrier is translated relative to the bolt body.

17. The rotatable bolt assembly of claim 3 further comprising a substantially L-shaped extractor pinned to the collar of the bolt body adjacent the bolt head.

18. The rotatable bolt assembly of claim 17 wherein the extractor body comprises a base portion projecting into the collar of the bolt body and pivotally attached to the bolt body by a hinge pin and a longitudinally extending body portion projecting forwardly and along one side of the bolt head and terminating with a slanted, hooked front end.

19. The rotatable bolt assembly of claim 18 wherein the hooked front end of the extractor body is adapted to engage a shell for extraction from a chamber of the firearm.

20. The rotatable bolt assembly of claim 18 wherein the extractor body further comprises a slot formed along an intermediate portion, the slot adapted to receive a reduced edge section of the bolt head defined by an extractor recess area, enabling the bolt head to rotate relative to the extractor while the extractor remains in a longitudinally fixed position relative to the rotating bolt head.

21. The rotatable bolt assembly of claim 20 further comprising an extractor spring received within the bolt body and extending along a recess to engage the base of the extractor.

22. The rotatable bolt assembly of claim 21 wherein the extractor pivots outwardly when the hooked front end engages and rides over a rim of the shell, the extractor spring then causing the extractor to pivot into a position engaging the shell for extraction from the chamber as the bolt assembly translates rearwardly.

23. The rotatable bolt assembly of claim 17 further comprising a shell support mounted along the bolt body on an opposite side of the bolt head from the extractor, the shell support including an elongated body having a slot formed along the length thereof for receiving an ejector.

24. The rotatable bolt assembly of claim 23 wherein the shell support engages and supports an opposite side of the shell against a force imparted by the extractor as the extractor is urged into engagement with the shell and functions with the extractor to hold the shell against the flat front face of the bolt head between extraction from the barrel and ejection from the firearm by the ejector.

25. A firearm, comprising:

a barrel;

a bolt assembly comprising:

a bolt body;

a bolt carrier translatable relative to the bolt body;

a bolt head received and retained within the bolt body; and a cam pin mounted to the bolt carrier and adapted to cause rotation of the bolt head as the bolt carrier is translated relative to the bolt body;

wherein the bolt head is maintained within the bolt body and against extension therefrom as the bolt head is rotated into and out of a battery condition in the barrel.

26. The firearm of claim 25 wherein the bolt assembly further comprises a bolt carrier blocker located along the bolt body and adapted to engage a receiver of the firearm and the bolt carrier as the bolt carrier is translated to lock the bolt head against rotation.

27. The firearm of claim 26 wherein the bolt carrier comprises a pair of carrier rod sleeves mounted on opposite sides of the bolt body and adapted to receive the carrier rods of the firearm for guiding the translating movement of the carrier and bolt body along the receiver.

28. The firearm of claim 25 wherein the bolt body comprises a cylindrical configuration including a forward end, a rearward end, a cylindrical outer wall, a collar at the forward end, and a centrally located bore defined therein for receiving the bolt head.

29. The firearm of claim 28 wherein the bolt head comprises a longitudinally extending body that is received within the bore of the collar of the bolt body and a transversely oriented forward portion at a first end of the bolt head engaging the collar of the bolt body and having a substantially flat face.

30. The firearm of claim 29 wherein the bolt assembly further comprises a cam surface formed at least partially along the body of the bolt head, the cam surface engaged by the cam pin of the bolt carrier to cause rotation of the bolt head.

31. The firearm of claim 30 wherein the bolt head further comprises a plurality of lugs at spaced locations around a periphery thereof, the plurality of lugs being disengaged from the barrel of the firearm by rearward movement of the cam pin along the cam surface as the bolt carrier translates rearwardly upon firing.

32. The firearm of claim 31 wherein the cam pin moves forwardly along the cam surface as the bolt carrier translates to a forward position with a return action of the firearm causing the plurality of lugs to engage corresponding lug cuts in the barrel of the firearm to lock the bolt head into engagement with the barrel in a battery condition for firing.

33. The firearm of claim 32 further comprising a firing pin received in a bore of the bolt body, the firing pin including a narrow forward end received and movable through a bore of the bolt head, an elongated body portion extending rearwardly therefrom, and a rearward end for engagement with a hammer of the firearm during a firing operation.

34. The firearm of claim 33 further comprising a firing pin spring mounted on the elongated body portion of the firing pin.

35. The firearm of claim 33 wherein the bolt assembly further comprises a retaining pin mounted within the bolt body adjacent a rear end thereof to engage the body portion of the firing pin and prevent rearward movement of the firing pin out of the bolt body.

36. The firearm of claim 28 wherein the bolt assembly further comprises an extractor including an extractor body, wherein the extractor body comprises a base portion projecting into the collar of the bolt body and pivotally attached to the bolt body by a hinge pin, and a longitudinally extending body portion projecting forwardly and along one side of the bolt head and terminating with a slanted, hooked front end.

37. The firearm of claim 36 wherein the extractor body further comprises a slot formed along an intermediate portion, the slot adapted to receive a reduced edge section of the bolt head defined by an extractor recess area, enabling the bolt head to rotate relative to the extractor while the extractor remains in a longitudinally fixed position relative to the rotating bolt head.

38. The firearm of claim 37 wherein the bolt assembly further comprises an extractor spring received within the bolt body and extending along a recess to engage the base of the extractor.

39. The firearm of claim 38 wherein the extractor pivots outwardly when the hooked front end engages and rides over a rim of the shell, the extractor spring then causing the extractor to pivot into a position engaging the shell for extraction from the chamber as the bolt assembly translates rearwardly.

40. The firearm of claim 36 wherein the bolt assembly further comprises a shell support mounted along the bolt body on an opposite side of the bolt head from the extractor, the shell support including an elongated body having a slot formed along the length thereof for receiving an ejector.

41. The firearm of claim 40 further comprising an ejector having an elongated rod with a proximal end adjacent to the bolt head and a distal end projecting from the rearward end of the bolt body and adapted to engage a rearward end of the receiver as the bolt assembly is translated to a full rearward position.

42. The firearm of claim 41 wherein the shell support engages and supports an opposite side of the shell against a force imparted by the extractor as the extractor is urged into engagement with the shell and functions with the extractor to hold the shell against the flat front face of the bolt head between extraction from the barrel and ejection from the firearm by the ejector.

* * * * *